US005460090A

United States Patent [19]

Pfeiffer et al.

[11] Patent Number: 5,460,090

[45] Date of Patent: Oct. 24, 1995

[54] METHOD AND DEVICE FOR ZONALLY CONTROLLING AND REGULATING INKING IN A PRINTING MACHINE

[75] Inventors: Nikolaus Pfeiffer, Heidelberg; Manfred Schneider, Bad Rappenau, both of Germany

[73] Assignee: Heidelberger Druckmaschinen AG, Heidelberg, Germany

[21] Appl. No.: 158,920

[22] Filed: Nov. 29, 1993

[30] Foreign Application Priority Data

Nov. 28, 1992 [DE] Germany ..... 42 40 077.5

[51] Int. Cl.[6] ..... B41F 31/00; B41M 1/00

[52] U.S. Cl. ..... 101/365; 101/485

[58] Field of Search ..... 101/181, 365, 101/DIG. 45, 211, DIG. 47, 483, 484, 485, 486, 170, 366, 148; 364/526

[56] References Cited

U.S. PATENT DOCUMENTS

| | | |
|---|---|---|
| 4,975,862 | 12/1990 | Keller et al. . |
| 5,023,812 | 6/1991 | Pfeiffer . |
| 5,122,977 | 6/1992 | Pfeiffer . |
| 5,182,721 | 1/1993 | Kipphan et al. . |

FOREIGN PATENT DOCUMENTS

| | | |
|---|---|---|
| 0228347 | 7/1987 | European Pat. Off. . |
| 0324718 | 7/1989 | European Pat. Off. . |
| 0337148 | 10/1989 | European Pat. Off. . |
| 0394681 | 10/1990 | European Pat. Off. . |
| 2416009 | 10/1975 | Germany . |

*Primary Examiner*—J. Reed Fisher

*Attorney, Agent, or Firm*—Herbert L. Lerner; Laurence A. Greenberg

[57] ABSTRACT

Method for zonally controlling and regulating inking in a printing machine having a plurality of printing units includes photo-electrically measuring, at least at one location of each inking zone, a printed product provided in the printing machine, determining an actual color locus from the measurements, comparing the determined actual color locus with a prescribed setpoint color locus of the respective location and, in the event of a spacing between the compared color loci, calculating corrective control data for inking elements of the printing machine and transmitting the control data to the printing units so as to minimize the spacing between the actual and setpoint color loci, the actual color locus meeting tolerance requirements by lying within a prescribed color tolerance and within a permissible region at a setpoint color locus characterized by an absence of color change; and device for performing the method.

13 Claims, 5 Drawing Sheets

METHOD AND DEVICE FOR ZONALLY CONTROLLING AND REGULATING INKING IN A PRINTING MACHINE

SPECIFICATION

The invention relates to a method for zonally controlling and regulating inking in a printing machine, more particularly, having a plurality of printing units; and to a device for performing the method.

Control of the inking or ink feed in the course of a printing process represents the most important possibility of influencing the printing of an image. An objective of the inking control is to achieve a best possible color matching between a so-called o.k.-sheet or proof and a printed product produced in a production run.

An essential improvement, in this regard, is to evaluate the control of the inking in accordance with colorimetric values, because a control in the sense of a balancing or equalization of reference or setpoint and actual color loci in a good approximation matches the color sensitivity of the human eye.

Spectral analyses of emissions from color measuring fields, the mathematical conversion of measurement values obtained therefrom into colorimetric values and further extended into control data for adjusting inking or ink-feeding elements or organs of a printing machine have become known heretofore in the art. In European Patent 02 28 347, in addition to a suitably outfitted printing machine and a measuring device for such a printing machine, a method for controlling inking is also described. Spectral remissions of given measurement fields are surveyed for balancing or equalizing the color between o.k.-sheets and sheets produced in printing and in a printing run. Respective color coordinates are calculated from the measurement values. By comparing the actual color locus with the corresponding setpoint color locus a possibly existing color spacing therebetween may be determined. The color spacing is converted into variations of coating thicknesses in the individual printing inks. The calculated variations in the coating thicknesses of the individual inks are passed on to the inking elements of the printing machine, so that the color spacing or distance between the actual color locus and the setpoint color locus becomes minimal.

Although the colorimetric control is optimally matched or adjusted to the color sensitivity of the human eye, the quality of the inking is subjected to certain limitations. These limitations are related to the technical realization of a control process:

A equalization or balancing of the actual color locus and the setpoint color locus preferably occurs only if the the actual color locus is outside a prescribed tolerance range or region lying at or around the the setpoint color locus. On the one hand, continuous controlling which produces instabilities is avoided thereby and, on the other hand, the fact is taken into consideration that every measurement and control process can be performed sensibly only within given error limits.

Color tolerance $E_{tol}$ at or around the setpoint color locus is so selected, for inking control in a printing machine, that the setpoint color locus lies in the middle of the tolerance space, and the human eye usually perceives no disturbing color changes within the tolerance. It can thus definitely be that, for a slightly reddish setpoint color locus, an actual color locus with a greater reddish tint is perceived as acceptable. If the actual color locus, however, has a slightly greenish tint for a color spacing of equal distance, the image may not be accepted. Due to the modern determination of the tolerance region, however, either a greenish, blueish and yellowish color tint is permitted or an unnecessarily small tolerance must be selected. A situation may then occur wherein, for example, the greenishness disturbs the visual sensitivity, i.e., in an extreme case, reject or waste sheets are printed notwithstanding that the actual color locus lies within the color tolerance $E_{tol}$ at or around the setpoint color locus.

It is accordingly an object of the invention to provide a method and a device of the type described in the introduction hereto, which excludes a non-tolerable presence of a color tint in a printed image.

With the foregoing and other objects in view, there is provided, in accordance with one aspect of the invention, a method for zonally controlling and regulating inking in a printing machine having a plurality of printing units, which comprises photo-electrically measuring, at least at one location of each inking zone, a printed product provided in the printing machine, determining an actual color locus from the measurements, comparing the determined actual color locus with a prescribed setpoint color locus of the respective location and, in the event of a spacing between the compared color loci, calculating corrective control data for inking elements of the printing machine and transmitting the control data to the printing units so as to minimize the spacing between the actual and setpoint color loci, the actual color locus meeting tolerance requirements by lying within a prescribed color tolerance and within a permissible region at a setpoint color locus characterized by an absence of color change. Thus, in accordance with the invention, an actual color locus is tolerable if it lies within the permissible region at or around the setpoint color locus wherein no color change or variation occurs, and the color spacing is smaller than the color tolerance $E_{tol}$.

In accordance with alternative modes, the method of the invention includes selecting a location in the subject of the printed product as the location of the respective inking zone to be measured, or includes selecting a location in a print control strip of the printed product as the location of the respective inking zone to be measured.

In accordance with another mode, the method includes selecting the measuring location so that it is in the vicinity of the achromatic axis (O,O,L) of a color space. Thus, the selected region corresponds to a so-called gray field wherein all printing-relevant colors appear.

n accordance with other alternative modes, the method includes performing the measuring step "in-line", or includes performing the measuring step "off-line".

In accordance with a further mode of the method of the invention, the permissible region meets a condition $h_0 \pm \alpha$, wherein $h_0$ represents a color-tone angle h of the setpoint color locus $E_{ref}$, and $\alpha$ represents a maximum permissible change in the color-tone angle h. As long as the actual color locus lies within this prescribed angular range or region, there is no danger whatsoever that any color change will occur in the printed image.

The selection of a permissible region in the form of an angular sector is convertible mathematically only with great difficulty for associated colorimetric calculations. Consequently, in accordance with an added mode, the method of the invention includes determining a tolerance region, namely a "no color-change" region, at or around a setpoint color locus $E_{ref}$ which lies within a prescribed color tolerance $E_{tol}$ and within the permissible region. This color tolerance involves a color space which, for example, can assume the shape of a sphere, an ellipsoid or a parallelepipedal. Other geometric spaces are also conceivable. This new color tolerance $E'_{tol}$ fulfills the following conditions: all of the points of $E'_{tol}$ lie within a prescribed tolerance $E_{tol}$ at or around the setpoint color locus, no color change occurs within $E'_{tol}$, and $E'_{tol}$ becomes a maximum for a given tolerance-space shape Additional modes of the method according to the invention take into account various steps having to do with the chromaticity $C_0$ of the setpoint color locus. Thus, in accordance yet another mode, the method of the invention includes providing that when chromaticity of the setpoint color locus meets a condition $C_0 \geqq C_{max}$, the color tolerance at the setpoint color locus is equal to the prescribed color tolerance. If the chromaticity $C_0$ of the setpoint color locus is high, i.e., the prescribed color tolerance always lies within the permissible region $h_0 \pm \alpha$, there is no danger of a color change, and each actual color locus which lies within the color tolerance at or around the setpoint color locus is treated by the control operation as a good color lochs.

In accordance with yet a further mode, the method of the invention includes providing that when chromaticity of the setpoint color locus meets the condition $C_{min} \leqq C_0 < C_{max}$, wherein $C_{min}$ represents the accuracy limit, a calculated color tolerance which is smaller than the prescribed color tolerance lies within the permissible region. T the aforestated condition, a danger arises of a color change with the acceptance of given actual color loci, because these, although lying yet within the color tolerance, do not, however, lie any longer within the permissible region. In this case, $C_{min}$ represents the accuracy limits with which any measurements or adjusting operations can be performed at the inking elements or organs.

In order, in this case, to ensure that no color change will occur, in accordance with yet an added mode, the method of the invention includes determining a new or alternative setpoint color locus lying in the center of the calculated color tolerance $E'_{tol}$ of maximum size. This alternative setpoint color locus lies, in fact, on the connecting line between the achromatic point and the setpoint color locus, but shifts farther away from the achromatic point. In this regard, $E'_{tol}$ is smaller than $E_{tol}$ yet greater than for a tolerance at or around $E_{ref}$ without color change.

In accordance with yet an additional mode, the method of the invention includes, when chromaticity of the setpoint color locus meets a requirement that $C_0 < C_{min}$, calculating with the determined tolerance region a new setpoint color locus having $C'_{lim} \cdot C_0/C_{min}$ as one of its coordinates, wherein $C'_{lim}$ represents the chromaticity of the setpoint color locus, and wherein $C_0 = C_{min}$. In this case, which is separately treated, the chromaticity $C_0$ of the setpoint color locus is smaller than the minimum possible chromaticity $C_{min}$. As mentioned hereinbefore, this minimal chromaticity $C_{min}$ represents the lower limit, respectively, for the measurement accuracy in the determination of the color locus and for the adjustment accuracy of the ink metering elements in the individual printing units. It thus makes little sense, in this regard, to set a condition at the tolerable actual color locus that the latter must lie within the permissible region, because a color change can no longer be prevented within the tolerances (for example, oscillations or fluctuations of the printing machine are too great). Furthermore, small fluctuations of the setpoint value may not lead to large fluctuations of the alternative setpoint color locus. The coordinates of the alternative setpoint color locus are:

$$(E_{tol}+C_0)/(1+\sin\alpha),\ h_0,\ L_0.$$

The color tolerance is calculated as follows:

$$E'_{tol}=(E_{tol}+C_0)\ .\ \sin\alpha/(1+\sin\alpha).$$

In accordance with a concomitant aspect of the invention, there is provided a device for zonally controlling and regulating inking in a printing machine with a plurality of printing units, comprising a detector for photo-electrically measuring, at least at one location of each inking zone, a printed product provided in the printing machine, and a computer and control device for determining an actual color locus from the measurements, for comparing the determined actual color locus with a prescribed setpoint color locus of the respective location and, in the event of a spacing between the compared color loci, for calculating corrective control data for inking elements of the printing machine and for transmitting the control data to the printing units so as to minimize the spacing between the actual and setpoint color loci, the computer and control device having means for checking whether the actual color locus meets tolerance requirements by lying within a prescribed color tolerance and within a permissible region at the setpoint color locus characterized by an absence of color change.

Other features which are considered as characteristic for the invention are set forth in the appended claims.

Although the invention is illustrated and described herein as embodied in a method and a device for zonally controlling and regulating inking in a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
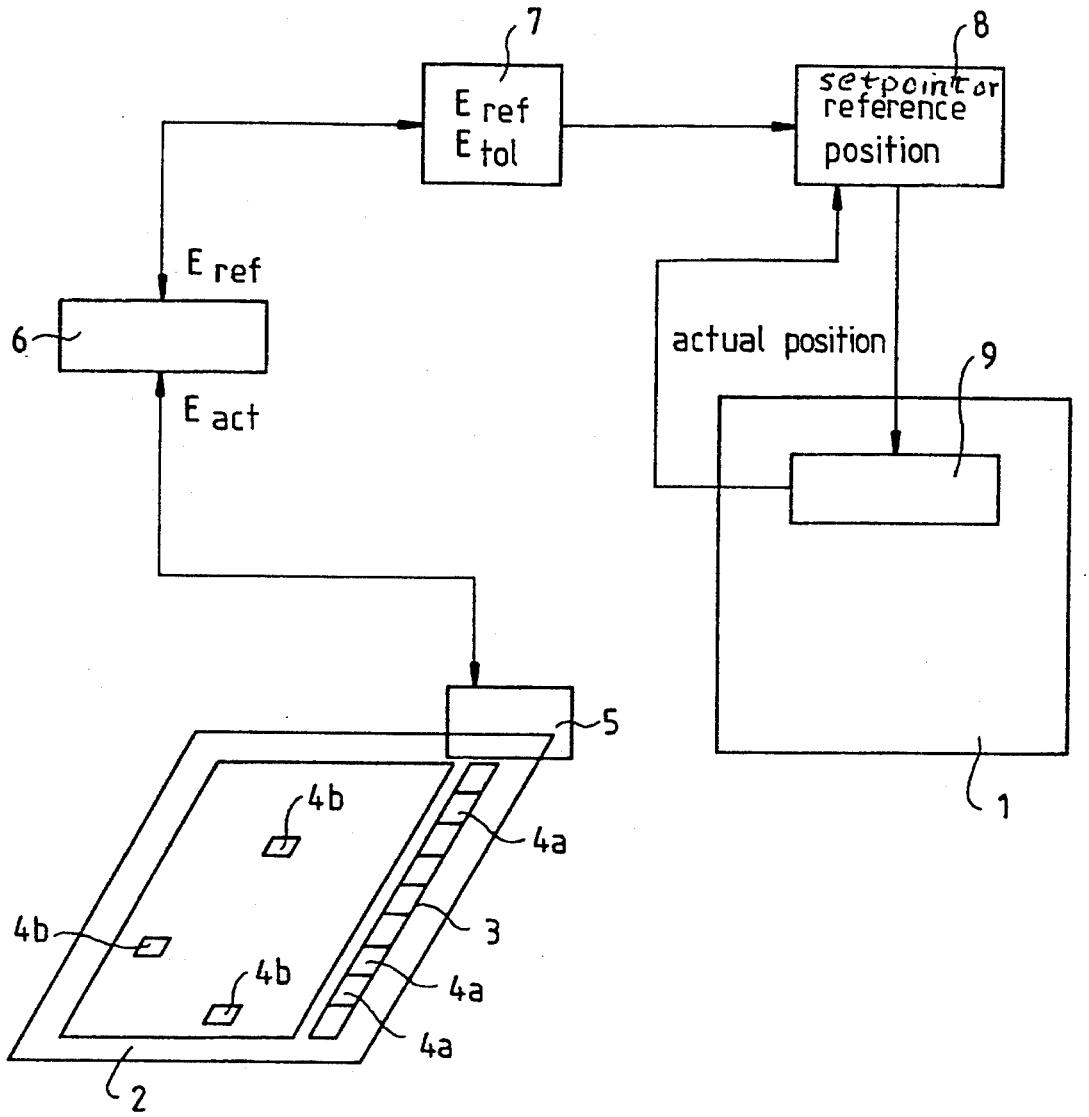
FIG. 1 is a block circuit diagram of the device according to the invention for zonally controlling and regulating inking in a printing machine.

Referring now to the drawings and, first, particularly to FIG. 1 thereof, there is shown therein a block circuit diagram of a preferred embodiment of the device for zonally controlling and regulating inking in a printing machine, in accordance with the invention. A printed product 2 provided in a printing machine 1 is scanned by a photo-electric detector 5 at given image areas or locations 4*a*, 4*b* which either lie in color or print control strips 4 or at relevant areas or locations of the subject or printed image. Positioning of the detector 5 is effected via a computer/control device 6 in accordance with input data supplied by an input/output device 7. In accordance with the information from the input/output device 7, the computer/control device 6 positions the detector at the selected measurement locations 4*a*, 4*b* of the printed product provided in the printing machine 1. The measurement locations 4*a*, 4*b* are selected either manually by the pressman or other operating personnel or automatically, taking prescribed data into consideration. In particular, the measurement locations 4a, 4b are usually selected per inking zone by the computer/control device 6 so that the color loci of the measurement locations 4a, 4b lie in the color space in the vicinity of the achromatic axis, because color deviations are usually perceived to be especially disturbing thereat. An actual color locus $E_{act}$ of the respective measurement field 4a, 4b is determined in the computer/control device 6 and is compared with a prescribed setpoint color locus $E_{ref}$. In accordance with the invention, depending upon the position of the actual color locus in the color space, both the setpoint color locus is shifted, as well as the prescribed tolerance $E_{tol}$ is newly established.

The effect of inking or ink feed in the measurement fields 4a, 4b of the printed product 2 occurs through corresponding variations in coating thickness in the individual printing units, i.e., the inking elements or organs 9 of the printing machine 1 are adjusted so that a measured actual color locus corresponds to or is identical with a prescribed setpoint color locus of the respective measurement location 4a, 4b. Such a method is adequately described in the published European Patent Document 03 24 718 A1.

A calculation of setpoint or reference position settings of the inking elements or organs 9 of the printing machine 1 is performed in an ink control unit 8 of conventional construction. A respective actual position setting of the inking elements or organs 9 in the printing units of the printing machine 1 is transmitted to the ink control or inking unit 9 by potentiometer answer-back signals.

In principal, the device and the method, respectively, according to the invention are applicable "in-line" or "off-line". The basic construction of a device with the "in-line" measurement, i.e., a direct measured-value detection or determination being effected at selected measurement areas or locations 4a, 4b of the printed product 2 in the printing machine 1, is described, for example, in the published German Patent Document 24 16 009 A1.

The method according to the invention in the instant application serves to exclude the occurrence of a color change within e color tolerance $E_{tol}$ at a reference or setpoint color locus $E_{ref}$.

Figure 2:
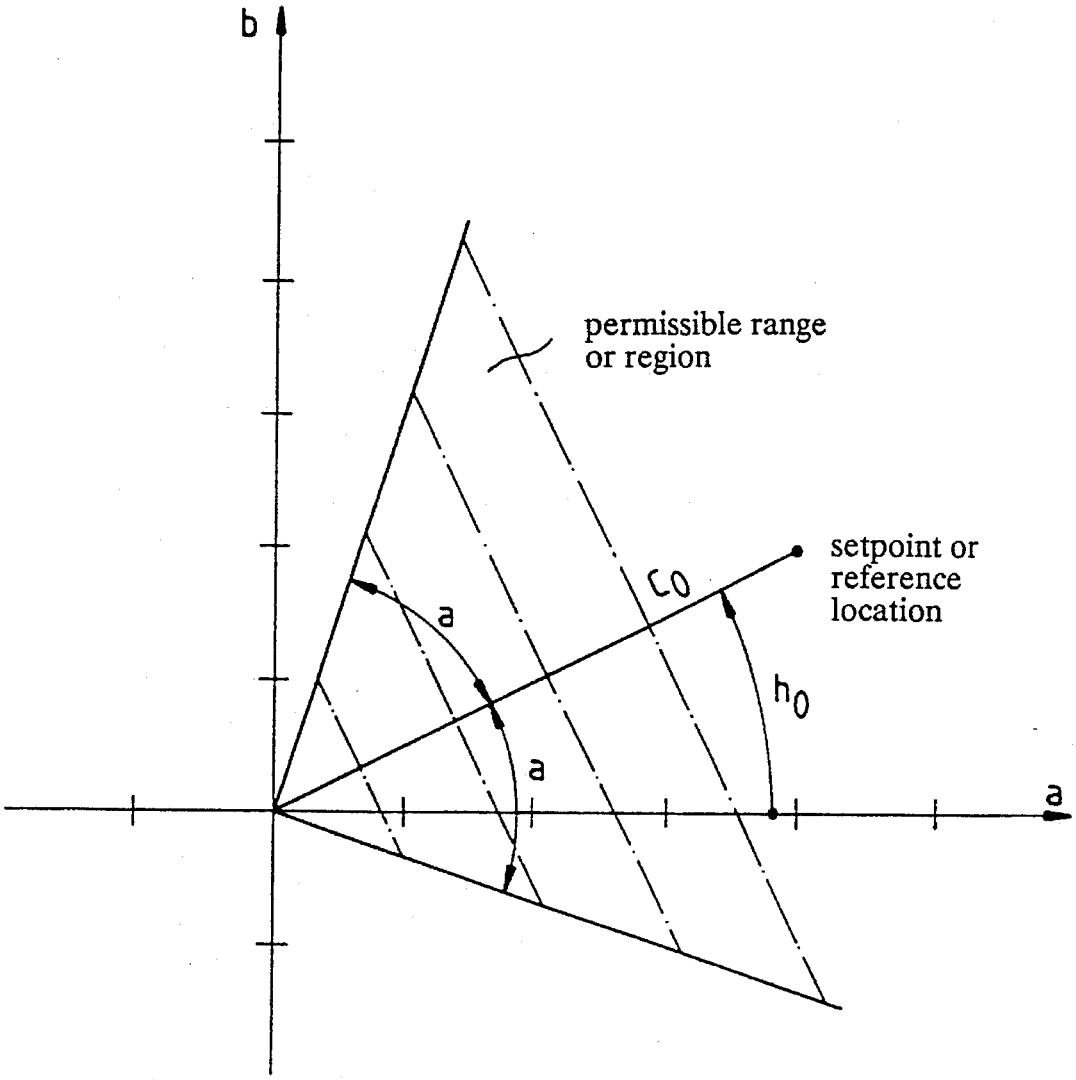
FIG. 2 is a plot diagram showing a permissible region in a color space.

In FIG. 2, the permissible region within which an acceptable actual color locus $E_{act}$ may lie without the perception of any disturbing color change by the human eye is shown in the a-b plane of the conventional L-a-b color space system of the CIE (Commission Internationale de l'Eclairage). Analogous considerations arise for the conventional L-u-v color space system of the CIE.

A color locus, namely the setpoint color locus $E_{ref}$ in FIG. 2, is defined in the color space by coordinates $C_0$, $h_0$ and $L_0$. The coordinate $C_0$ graphically characterizes the chromaticity of the setpoint color locus $E_{ref}$, and $h_0$ the colortone angle of the setpoint color locus $E_{ref}$. The brightness $L_0$ represented by a coordinate line extending perpendicularly to the coordinate lines a and b at the point of intersection thereof, is of no importance and plays no part in the inventive method of the instant application.

The so-called permissible region lies at the setpoint color locus $E_{ref}$ within the angular region $h_0 \pm \alpha$, i.e., if an actual color locus $E_{act}$ lies within this permissible region, the human eye perceives no disturbing color change. In the illustrated example of FIG. 2, the angle $\alpha$, which reflects the maximum permissible change in the color-tone angle h, is 45°. Only within the range of this angle $\alpha$ are printing results obtained which are yet acceptable to the human eye.

Figure 3:
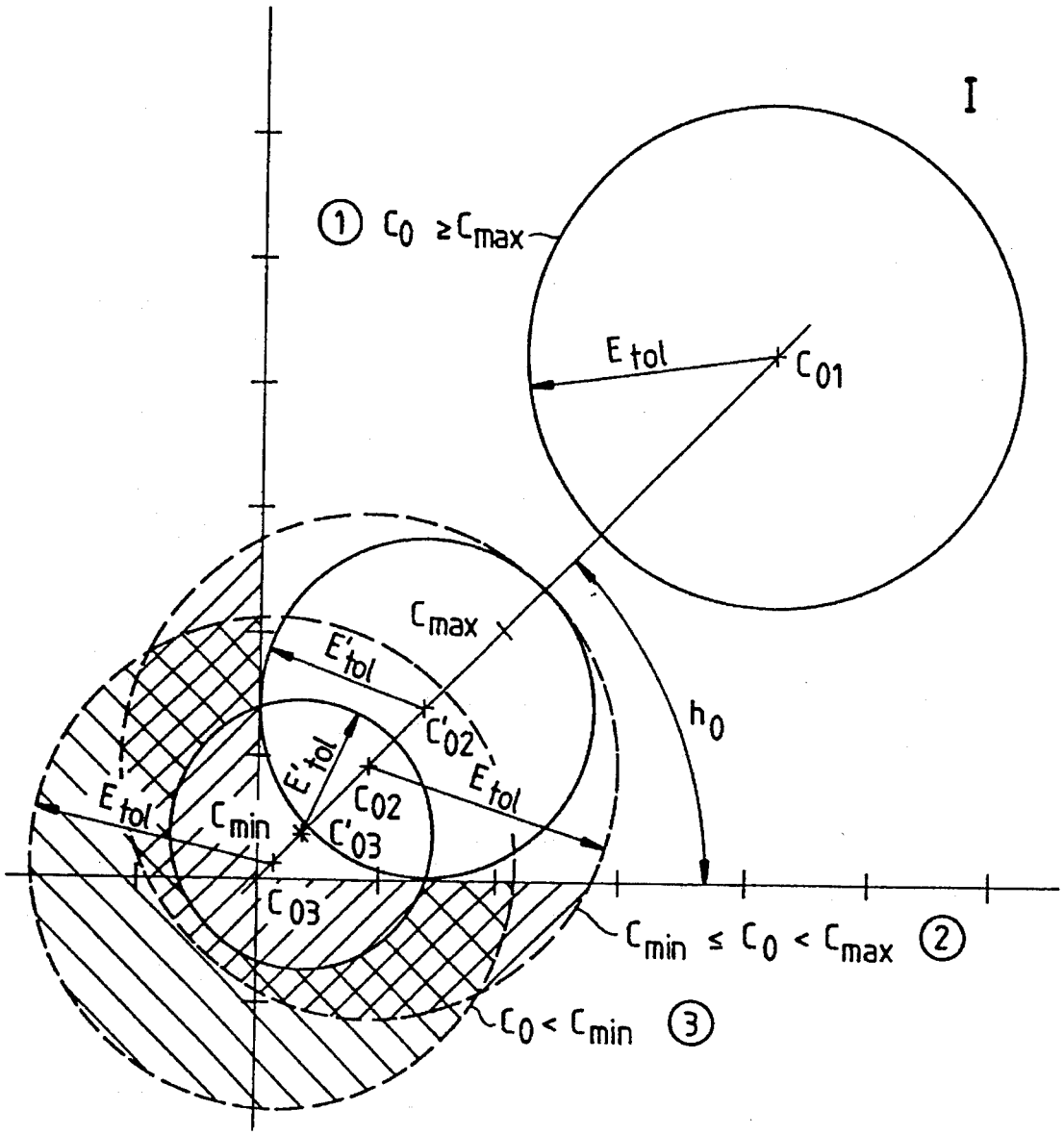
FIG. 3 is a plot diagram similar to that of FIG. 2 representing the method according to the invention in the color space.

FIG. 3 diagrammatically represents various modes of the method according to the invention. As in FIG. 1, the position of the respective setpoint color locus $E_{ref}$ is represented with the coordinates $C_0$, $h_0$, $L_0$ in the a-b and in the u-v planes, respectively, of the corresponding color spaces. Quadrant I of the a-b and the u-v planes, respectively, is selected as the permissible angular region. In the case at hand, the coordinate $h_0$ corresponds to the angle $\alpha$=45° from FIG. 1. It should be mentioned again that the permissible region is the angular region at the setpoint color locus $E_{ref}$ wherein no color change disturbing to human color perception occurs.

Depending upon the position of the setpoint color locus $E_{ref}$, characterized by the varying coordinates $C_{01}$, $C_{02}$ and $C_{03}$, respectively, three different cases are to be distinguished. In the first case, the chromaticity $C_{01}$ of the setpoint color locus $E_{ref\,1} \geqq C_{max} = i/\sin\alpha.\ E_{tol}$. As long as this condition is fulfilled, an actual color locus $E_{act}$ can lie at any desired location of this tolerance region $E_{tol}$ without the occurrence of any color change in the printed image. If $\alpha$=45°, then the maximum permissible chromaticity $C_{max}$ must have a value at least 1.4 times the value of the color tolerance $E_{tol}$.

A color change becoming noticeable negatively may occur the instant the chromaticity of the setpoint color locus $E_{ref\,2}$ becomes smaller than the maximum permissible chromaticity $C_{max}$. For this second case, there is an additional requirement that the chromaticity $C_{02} \geqq C_{min}$, i.e., in summary, the chromaticity $C_{02}$ of the setpoint color locus fulfills the condition: $C_{min} \leqq C_{02} < C_{max}$.

If the color regulation/color control should then accept all of the actual color loci $E_{act}$, which lie within the color tolerance $E_{tol}$ at the setpoint color locus $E_{ref}$ with the chromaticity $C_{02}$, non-acceptable printing results would then be produced in the cross-hatched region shown in FIG. 3, because the permissible region wherein no color change occurs is abandoned thereat. In this case, the method of the invention provides as follows: in the circular sector of the color tolerance $E_{tol}$ remaining in the interior of the permissible region $2.h_0$, is placed which does not abandon the permissible region at any location. The center point of this tolerance circle becomes a alternative setpoint color locus with $C'_{02}$. The new alternative setpoint color locus with $C'_{02}$ has the coordinates $(E_{tol} + C_0)/(1+\sin\alpha)\ h_0,\ L_0$.

The calculated color tolerance E' may be expressed mathematically as follows:

$$E'_{tol} = (E_{tol} + C_0)\ .\ \sin\alpha/(1+\sin\alpha)$$

From FIG. 3, the procedure which is applied is furthermore apparent when the chromaticity $C_{03}$ of the setpoint color locus $E_{ref\,3}$ is smaller than the minimum chromaticity $C_{min}$. tolerance. $C_{min}$ lies in the region of the measurement As described hereinbefore, $C_{min}$ identifies the minimum color accuracy of the adjustment values for the inking or ink-feeding elements or organs 9 of the printing machine. If then, as in the preceding case, only a color tolerance $E'_{tol}$ were permitted which lies within the permissible region, a control would take place although the control accuracy does not permit this. On the other hand, a color tolerance $E_{tol}$ at the setpoint color locus with the chromaticity $C_{03}$ in the single-hatched region definitely results in color changes in the printed image.

If the chromaticity $C_{03}$ of the setpoint color locus $E_{ref\,3}$ is smaller than $C_{min}$, the following procedure is suggested:

The value of the calculated color tolerance $E'_{tol}$ is selected as for the setpoint color locus at which $C_0 = C_{min}$. The alternative setpoint color locus $E_{ref\,3}$ has the coordinates:

$$(C'_{03} = C'_{lim}.\ C_0/C_{min})\ h_0,\ L_0.$$

In this regard, $C_{min}$ characterizes the color locus for which $C_O=C_{min}$.

The color tolerance $E'_{tol}$ of the alternative setpoint color locus with $C'_{03}$ may be expressed by the following equation:

$$E'_{tol}=(E_{tol}+C_{min}) \cdot \sin \alpha/(1+\sin \alpha).$$

From the preceding description, it may be concluded that the problem of a color change becomes apparent only if a setpoint color locus lies within a given spatial region at the $L_0$ axis, i.e., the measurement locations which are used for recognizing or detecting a disturbing color change must lie in the vicinity of the achromatic axis $L_0$.

Figure 4:
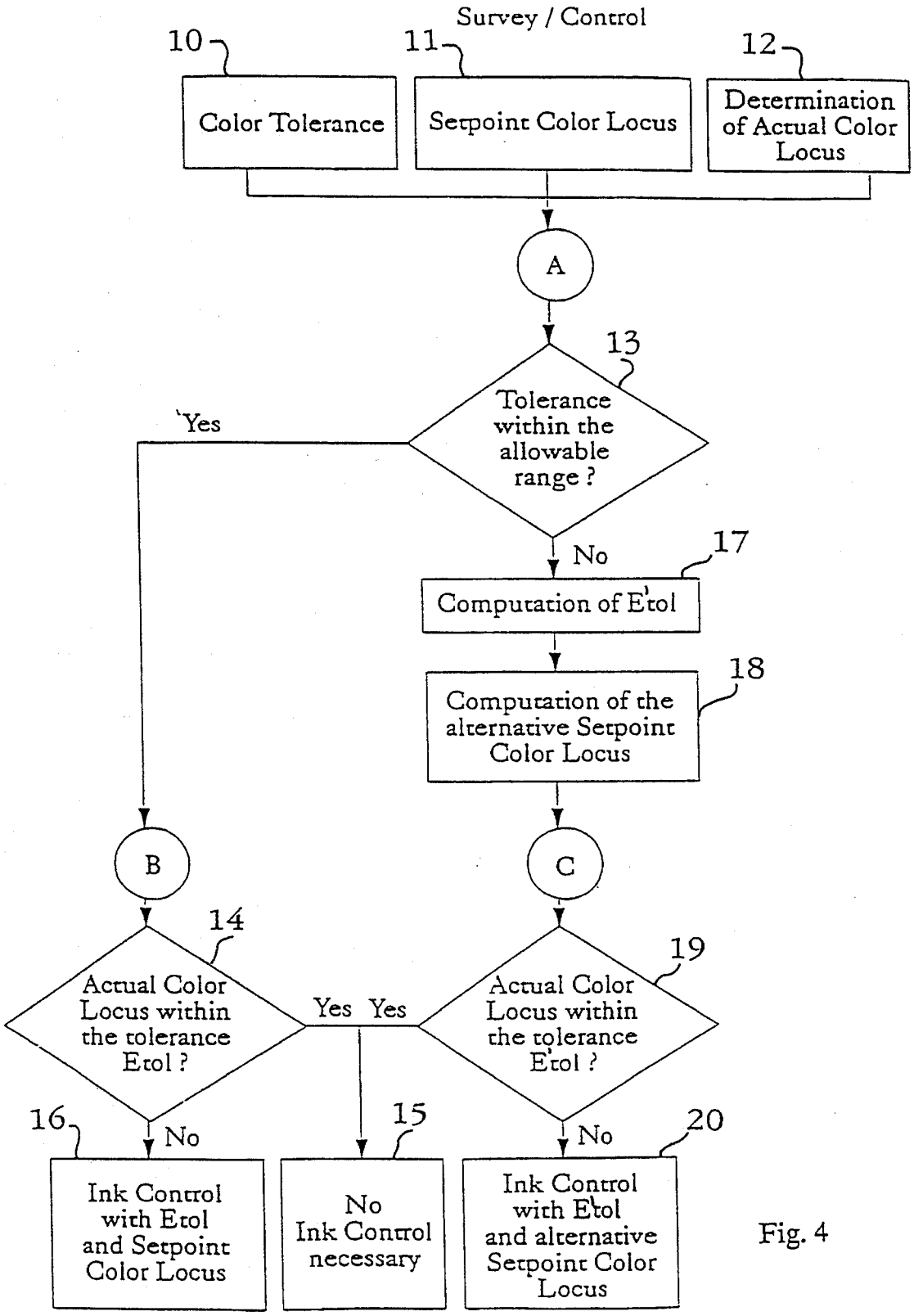
FIGS. 4 and 5 are respective flow charts for clarifying the operation of the computer and control device of the invention.

As shown in the flow chart of FIG. 4, values of the color tolerance at 10, the setpoint color locus at 11 and the determined actual color locus are passed through node A to 13, at which a determination is made as to whether the tolerance is within the allowable range If "Yes" after node B, a query is made at 14 as to whether the actual color locus is within the tolerance $E_{tol}$. If affirmative, no ink control is necessary, as indicated at 15; if negative, ink control with $E_{tol}$ and setpoint color locus is effected at 16.

If the answer at 13 is "No" $E'_{tol}$ is computed at 17, followed by a computation of the alternative setpoint color locus at 18 and, after passing the node C, a query is made at 19 as to whether the actual color locus is within the tolerance $E'_{tol}$. If affirmative, no ink control is necessary, as indicated at 15; if negative, ink control with $E'_{tol}$ and the alternative setpoint color locus is effected at 20.

Figure 5:
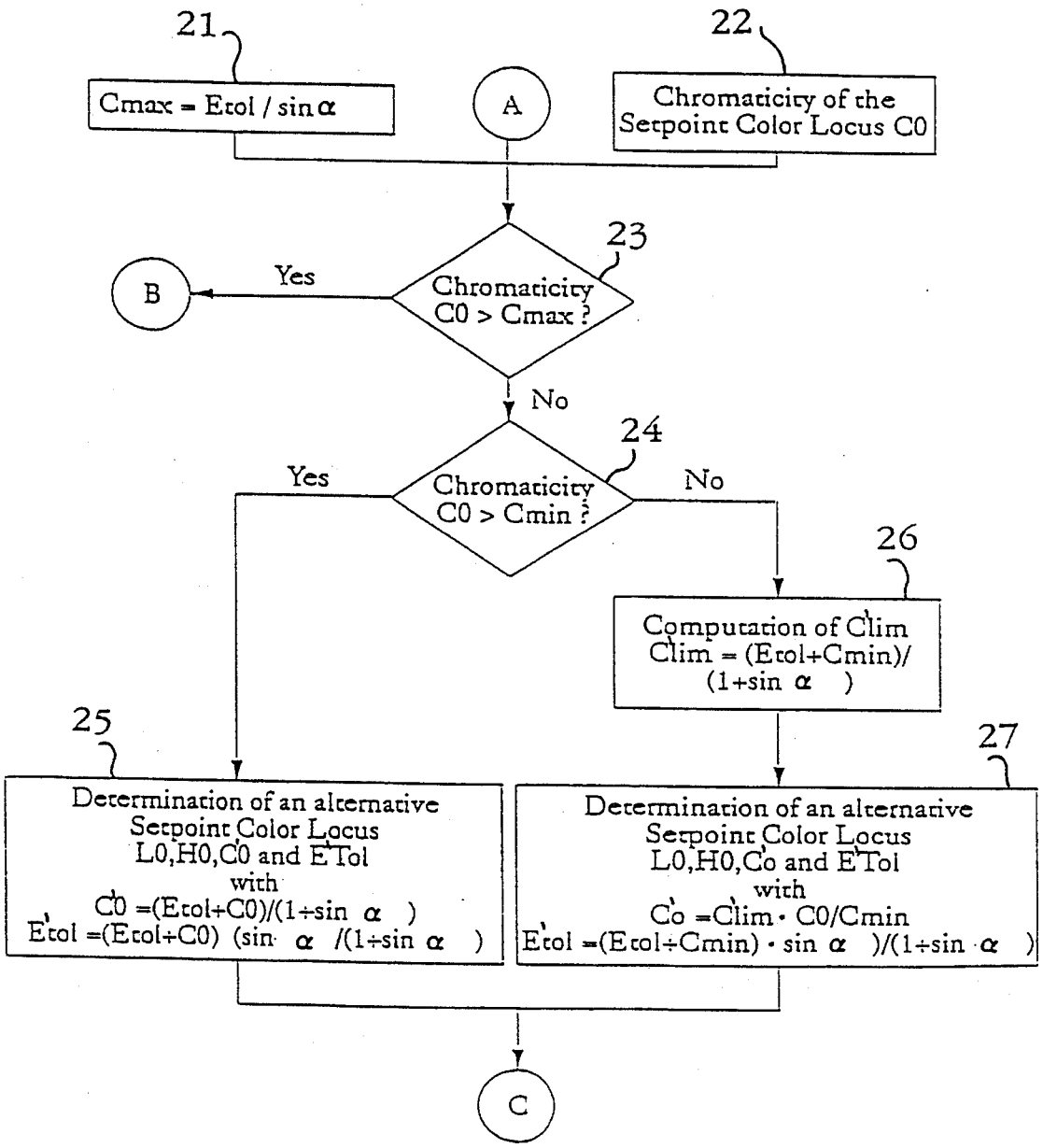

In the flow chart of FIG. 5, following the node A, the maximum chromaticity $C_{max}$ at 21 and the chromaticity of the setpoint color locus $C_0$ at 22 are passed to 23 at which they are compared. If the chromaticity $C_0$ is greater than $C_{max}$, the path to node C is opened; if $C_0$ is smaller than or equal to $C_{max}$, a query is made at 24 whether $C_0>C_{min}$. If answered in the affirmative, at 25, a determination of an alternative setpoint color locus $L_0,h_0,C_0$ and $E'_{tol}$ with $C'_0=(E_{tol}+C_0)/(1+\sin \alpha)$ and $E'_{tol}=(E_{tol}+C_0) \cdot \sin \alpha/(1+\sin \alpha)$, and the result is passed to the node C. If answered in the negative, a computation $C'_{lim}=(E_{tol}+C_{min})/(1+\sin \alpha)$ is made at 26. The result thereof is fed to 27 wherein a determination of an alternative setpoint color locus $L_0,h_0,C'_0$ and $E'_{tol}$ is made with $C'_0=C'_{lim} \cdot C_0/C_{min}$ and $E'_{tol}=(E_{tol}+C_{min}) \cdot \sin \alpha/(1+\sin \alpha)$. The determination in 27 is then fed to the node C.

We claim:

1. Method for zonally controlling and regulating inking in a printing machine having a plurality of printing units, which comprises photo-electrically measuring, at least at one location of each inking zone, a printed product provided in the printing machine, defining a color space having defined color loci, determining an actual color locus in the color space from the measurements obtained in the measuring step, comparing the actual color locus obtained in the determining step with a prescribed setpoint color locus of the at least one location and, in the event of a spacing between the color loci compared in the comparing step, calculating corrective control data for inking elements of the printing machine and transmitting the control data to the printing units so as to minimize the spacing between the actual and setpoint color loci, the actual color locus meeting tolerance requirements by lying within a prescribed color tolerance and within a permissible region at a setpoint color locus characterized by an absence of color change.

2. Method according to claim 1, which includes selecting a location in the subject of the printed product as the location of the respective inking zone to be measured.

3. Method according to claim 1, which includes selecting a location in a print control strip of the printed product as the location of the respective inking zone to be measured.

4. Method according to claim 1, wherein the color space defined in the defining space has an achromatic axis, and which includes selecting the measuring location so that it is in the vicinity of the achromatic axis of the color space.

5. Method according to claim 1, which includes performing the measuring step "in-line" with regard to the printing machine.

6. Method according to claim 1, which includes performing the measuring step "off-line" with regard to the printing machine.

7. Method according to claim 1, wherein the permissible region meets a condition $h_0 \pm \alpha$, wherein $h_0$ represents a color-tone angle of a setpoint color locus, and $\alpha$ represents a maximum permissible change in the color-tone angle.

8. Method according to claim 1, which includes determining a tolerance region at a setpoint color locus which lies within a prescribed color tolerance and within the permissible region.

9. Method according to claim 8, which includes providing that when chromaticity of the setpoint color locus meets a condition $C_0 \geqq C_{max}$, the color tolerance at the setpoint color locus is equal to the prescribed color tolerance.

10. Method according to claim 8, which includes, when chromaticity of the setpoint color locus meets a requirement that $C_0<C_{min}$, calculating with the determined tolerance region a new setpoint color locus having $C'_{lim} \cdot C_0/C_{min}$ as one of its coordinates wherein $C'_{lim}$ represents the chromaticity of the setpoint color locus, and wherein $C_0=C_{min}$.

11. Method according to claim 8, which includes providing that when chromaticity of the setpoint color locus meets the condition $C_{min}$23 $C_0<C_{max}$, wherein $C_{min}$ represents the accuracy limit, a calculated color tolerance which is smaller than the prescribed color tolerance lies within the permissible region.

12. Method according to claim 10, which includes determining a new setpoint color locus lying in the center of the calculated tolerance region.

13. Device for zonally controlling and regulating inking in a printing machine with a plurality of printing units, comprising a detector for photo-electrically measuring, at least at one location of each inking zone, a printed product provided in the printing machine, and a computer and control device for determining an actual color locus of the at least one location in a predefined color space, for comparing the actual color locus with a prescribed setpoint color locus of the at least one location and, in the event of a spacing between the actual and setpoint color loci, for calculating corrective control data for inking elements of the printing machine and for transmitting the control data to the printing units so as to minimize the spacing between the actual and setpoint color loci, said computer and control device having means for checking whether the actual color locus meets tolerance requirements by lying within a prescribed color tolerance and within a permissible region at said setpoint color locus characterized by an absence of color change within the permissible region.

* * * * *